US007797779B2

(12) United States Patent
Bizzo

(10) Patent No.: US 7,797,779 B2
(45) Date of Patent: Sep. 21, 2010

(54) SEMI-BED SHOE CONSTRUCTION METHOD AND PRODUCTS PRODUCED BY THE SAME

(75) Inventor: Luca Bizzo, Holmdel, NJ (US)

(73) Assignee: Aerogroup International Holdings LLC, Edison, NJ (US)

( * ) Notice: Subject to any disclaimer, the term of this patent is extended or adjusted under 35 U.S.C. 154(b) by 732 days.

(21) Appl. No.: 11/758,651

(22) Filed: Jun. 5, 2007

(65) Prior Publication Data

US 2008/0028545 A1 Feb. 7, 2008

Related U.S. Application Data

(60) Provisional application No. 60/803,979, filed on Jun. 5, 2006.

(51) Int. Cl.
*A43B 13/28* (2006.01)
*A43B 13/16* (2006.01)

(52) U.S. Cl. ..... 12/142 C; 12/142 T; 36/12; 36/18; 36/21; 36/30 R

(58) Field of Classification Search ..... 12/142 C, 12/142 T, 142 RS; 36/12, 18, 21, 30 R, 19 R, 36/19 A, 25 R, 28, 31
See application file for complete search history.

(56) References Cited

U.S. PATENT DOCUMENTS

| | | | | |
|---|---|---|---|---|
| 1,539,507 | A * | 5/1925 | Prenzel | 12/142 D |
| 2,351,818 | A * | 6/1944 | Joyce, Jr. | 36/19.5 |
| 2,554,159 | A * | 5/1951 | Stritter | 12/142 F |
| 3,344,537 | A * | 10/1967 | Diamant | 36/91 |
| 4,590,690 | A * | 5/1986 | Pfander | 12/142 C |
| 5,203,793 | A | 4/1993 | Lyden | |
| 6,305,101 | B2 * | 10/2001 | Chemello | 36/54 |
| 7,168,187 | B2 * | 1/2007 | Robbins | 36/30 R |
| 2006/0265908 | A1 * | 11/2006 | Palmer et al. | 36/29 |

* cited by examiner

*Primary Examiner*—Ted Kavanaugh
(74) *Attorney, Agent, or Firm*—Lackenbach Siegel, LLP; Andrew F. Young

(57) ABSTRACT

The present invention relates to a method of manufacturing footwear. More specifically, the present invention relates to a construction method wherein a first front portion of a shoe is manufactured by a first method and a second rear portion of the shoe is manufactured by a second different adhesive gluing method. The present invention provides a novel incorporation differing shoe construction methods to overcome substantial manufacturing detriments while retaining the ability of the shoe construction to respond to fashion or appearance type needs.

5 Claims, 8 Drawing Sheets

Fig. 5
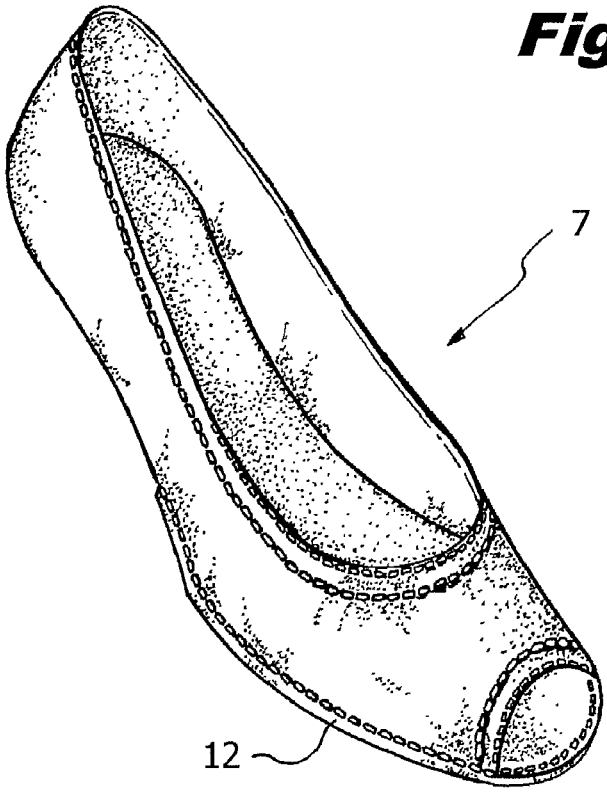
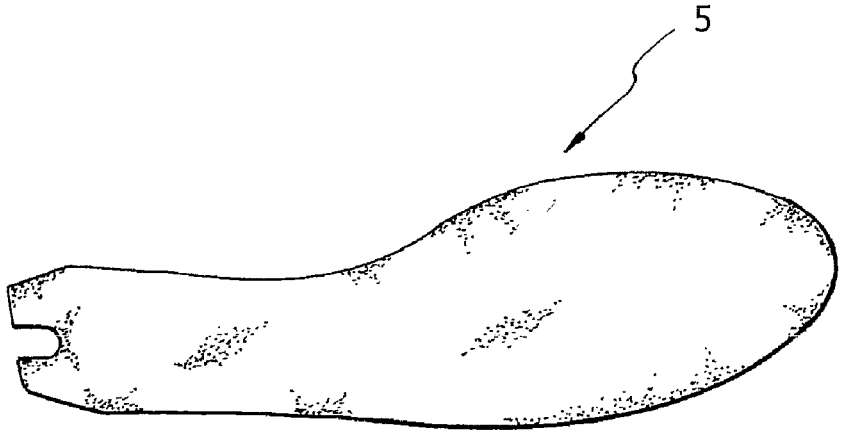
Fig. 6

Fig. 9
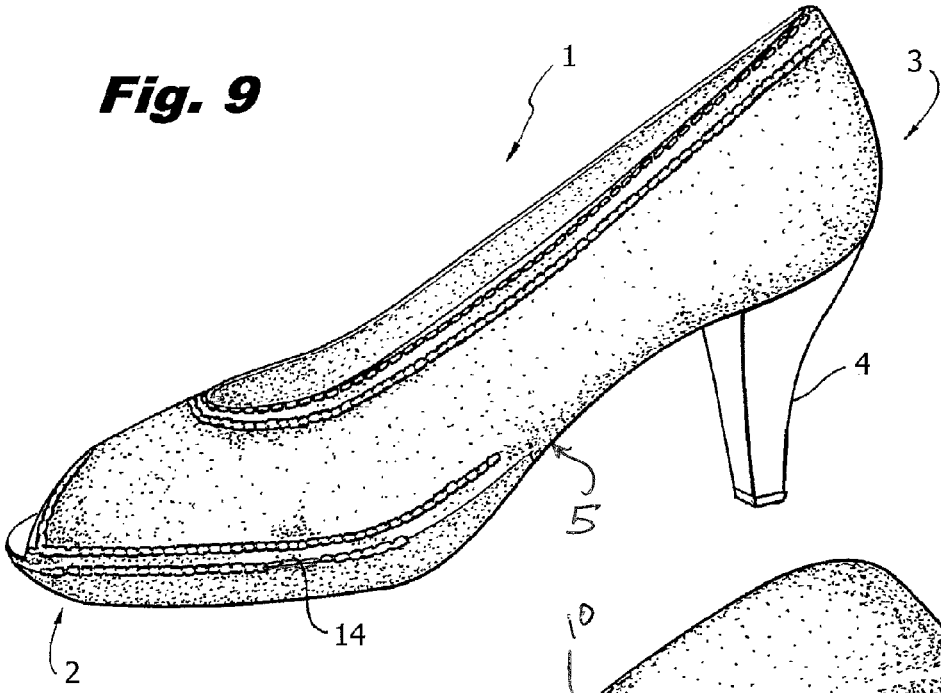
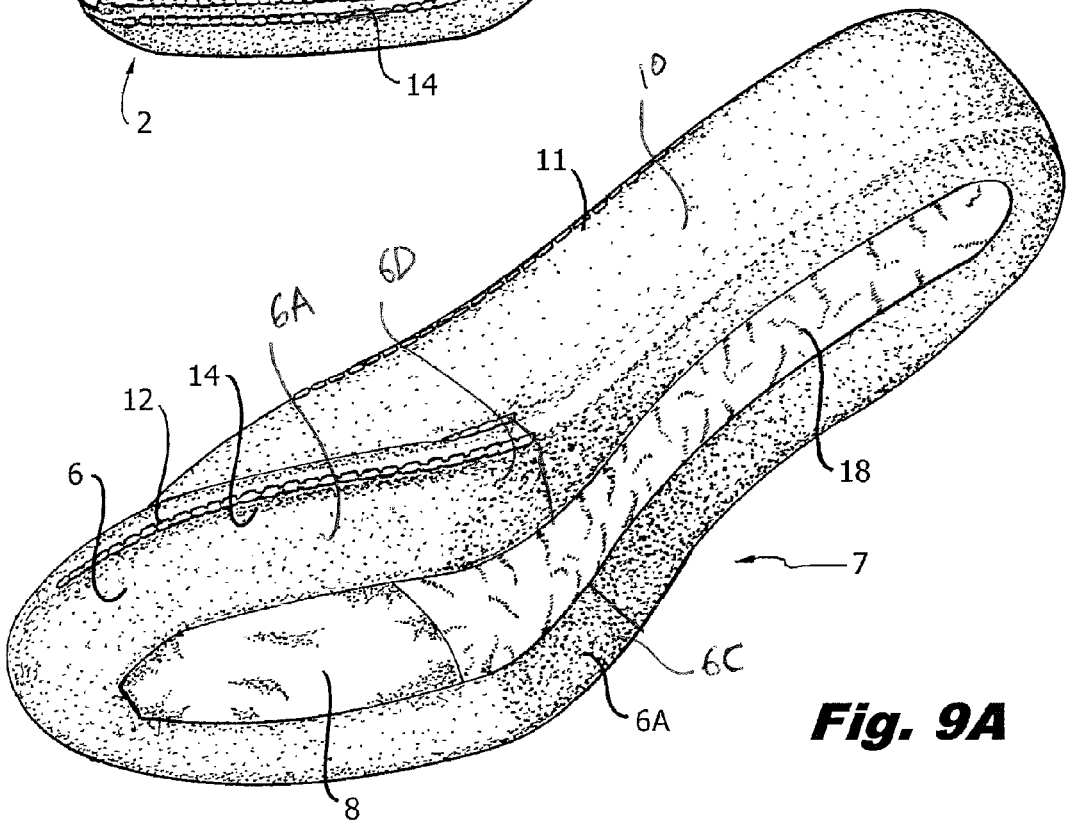
Fig. 9A

Fig. 10
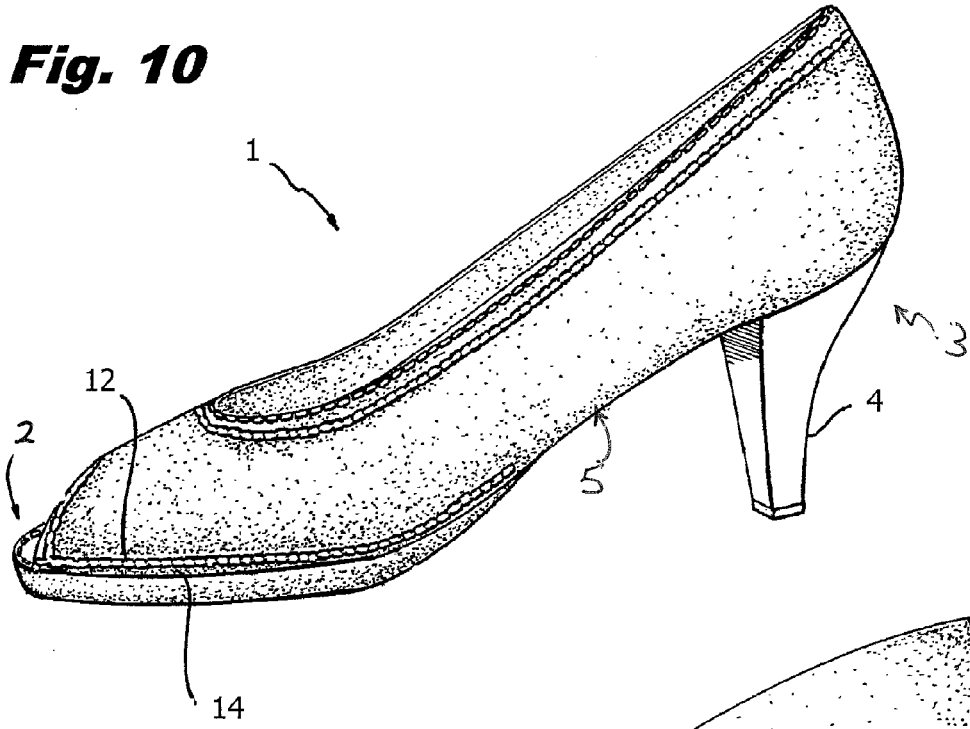
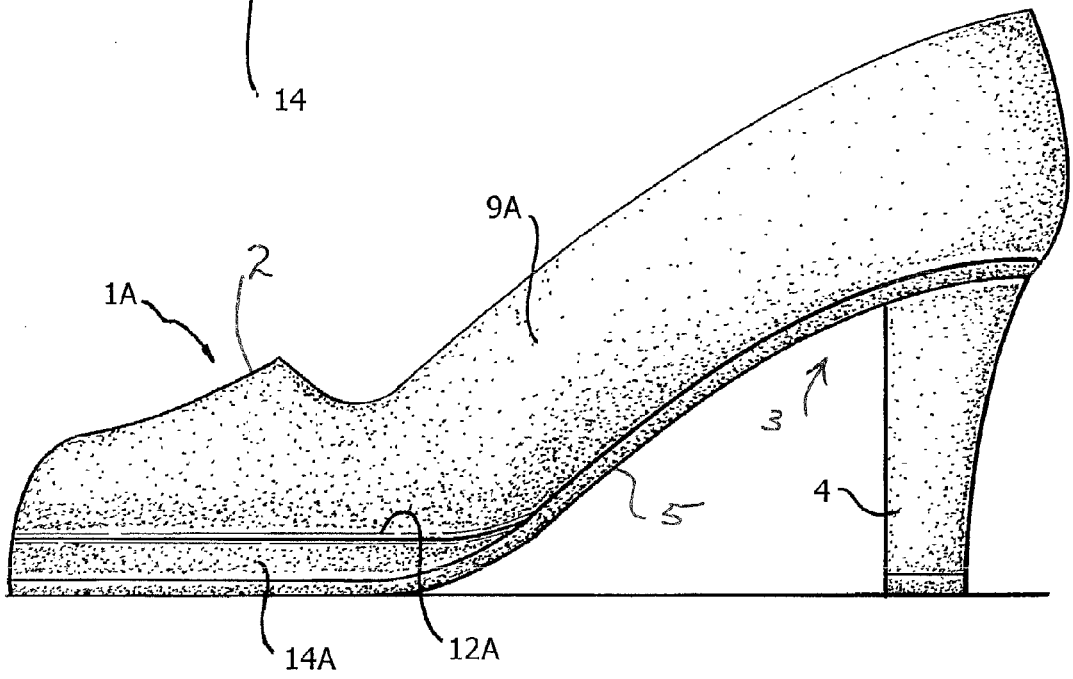
Fig. 11

SEMI-BED SHOE CONSTRUCTION METHOD AND PRODUCTS PRODUCED BY THE SAME

CROSS REFERENCE TO RELATED APPLICATIONS

This application claims priority from U.S. Prov. App. 60/803,979 Filed Jun. 5, 2006, the entire contents of which are herein incorporated by reference.

BACKGROUND OF THE INVENTION

1. Field of the Invention

The present invention relates to a method of manufacturing footwear. More specifically, the present invention relates to a construction method wherein a first front portion of a shoe is manufactured by a first stitching method (including a "California" type stitching construction method) and a second rear or heal portion of the shoe is constructed by a second adhesive gluing method.

2. Description of the Related Art

Referring now to FIGS. 1B, 1C, and 1D, variants of known "California" type shoe constructions are shown. As used herein, "California" type constructions may be either a closed-stitch type (FIGS. 1B and 1D and shoes 16A, 16B) seam-hidden or a reverse-stitch type (FIG. 1D and shoe 16) seam-exposed style of construction. Respectively, these types are commonly referred to as either the "California" or "Reverse California" type of constructions.

In conventional shoe embodiments 16, 16A, and 16B (FIGS. 1B, 1C, and 1D), with either of the conventional "California" type constructions, an upper member or foot bed member is stitched to a glue tongue transition member 15 by either a concealed (reversed) seam or an exposed (box-seam type) stitching respectively 15A, 15B (FIG. 1C) as shown.

In the conventional arts, the result of either California style is the continuous exposure, about the entire outer perimeter of the shoe above the sole of the transition member 15.

As will be best understood by those of skill in the art, both the conventional California construction and the conventional reversed California construction have critical benefits that have supported their use; namely easy display of patterned or colored fabric for style and appearance reasons, as well as for ease of manufacturing assembly (flexibility). Ultimately, conventional transition members 15 are always a very soft and pliable, and easily scuffed or consumed leather member that is exposed to damage about the entire outer periphery of the shoe. Additionally, conventional construction methods involving conventional transition members 15 also have substantial detriments including difficult and weaker construction, and the ready failure of separation at the bend-joint regions of a shoe, particularly the highly physically stressed fashion shoe market where there is little room for physical support.

Both conventional California styles require complete control of the overall thickness of the bottom stitch members 15 and stitches 15A, 15B to both provide a uniform appearance (tight and neat appearance) about the entire periphery of the shoe bed and a secure product (limit separation at the shoe-bend region between heel and toe). This requirement for complete control of so many production variables further increases manufacturing time, failure rates, and costs.

Additionally, as can be best seen in FIG. 1C, the continuous stitch seam 15A adjacent the insole and heal portion of a shoe increases the risk of foot irritation and stitch-damage during use.

Ultimately, as can be see in FIG. 1C, the continuous outer stitch 15B, when exposed (reversed), can be a source of continual foot irritation as the stitching tends to be irritating to the sole of a wearer's foot.

All these detriments known in the related shoe construction arts have lead manufacturers to eliminate or prevent usage of the continuous outer seam constructions 15 on shoes having more complex uppers, or uppers that enclose a substantial portion of the foot.

Thus, while the conventional arts provide an attractive product, the resultant is a construction that is difficult to produce, retains inherent weaknesses following even the best construction techniques, and is non-adaptive to the present needs of the footwear industry. As a consequence, there is a need for an improved semi-bed shoe construction method and system that addresses the needs noted above.

OBJECTS AND SUMMARY OF THE INVENTION

An object of the present invention is to provide a method of manufacturing employing a first manufacturing step in a toe portion and a differing manufacturing step in a heal portion of a shoe.

According to an embodiment of the present invention there is provided a method for modifying a California-style stitching operation that incorporates a novel transition to a differing shoe construction method proximate the insole region of a shoe for increased strength of final construction and flexibility of design, and an elimination of the detriments noted above while retaining a majority of the benefits.

According to another embodiment of the present invention, there is provided a method for construction with enables the use of both an exposed and concealed seam proximate the foot bed following a region of an exposed member for improving a freedom of construction methods (styling), without providing a corresponding weakness in construction strength mandated by the previously-known construction methods.

The present invention relates to a method and system for manufacturing footwear. More specifically, the present invention relates to a construction method wherein a portion of a shoe is manufactured by a semi-California stitch and glue method and a second portion manufactured by an adhesive gluing method, thereby a formal and an informal semi-California stitching and assembly process.

According to another embodiment of the present invention, there is provided a method for manufacturing a shoe, comprising the steps of: employing a stitch method for securing an upper glue tongue portion to a toe portion of an upper portion, adhesively securing a portion of the upper glue tongue portion extending from the upper portion to a cushion member on an inner side thereof, adhesively securing the portion of the upper glue tongue portion to a top surface of a sole assembly on an outer side thereof, at least one of a step of employing a glue to a top portion of a sole construction member, and applying a glue to the outer side of the upper glue tongue portion thereby securing a toe region of the sole construction member to the outer surface of the upper glue tongue portion, and adhesively securing a heal portion of the now-assembled upper portion to the sole construction member, there by enabling an alternative method for manufacturing a shoe.

According to another embodiment of the present invention, there is provided one of a shoe assembly system and a shoe product manufactured by the above method.

The above, and other objects, features and advantages of the present invention will become apparent from the following description read in conduction with the accompanying drawings, in which like reference numerals designate the same elements.

BRIEF DESCRIPTION OF THE DRAWINGS

FIG. 5 is a side perspective view of an assembled upper member combining an upper member, upper glue tongue member with glue flanges, the foam cushion member and (in this construction) a board support member.

FIG. 6 is a top plan view of a sole member prior to assembly with the assembled upper noted in FIG. 5.

FIG. 9 is a side perspective view of an assembled semi-seam construction according to one embodiment of the present invention.

FIG. 9A is a bottom perspective view of FIG. 5 prior to assembly showing the detail of the upper glue tongue and glue tongue flanges or exposure regions at the toe portion and the underside of the board support member 18 along the central and heal portion.

FIG. 10 is a topside perspective view of an assembled shoe as seen in FIG. 9 having a reversed-semi-seam construction.

FIG. 11 is topside perspective view of a second alternative embodiment of an assembled shoe having a classic or concealed-semi-seam construction.

DETAILED DESCRIPTION OF THE PREFERRED EMBODIMENTS

Figure 1A:
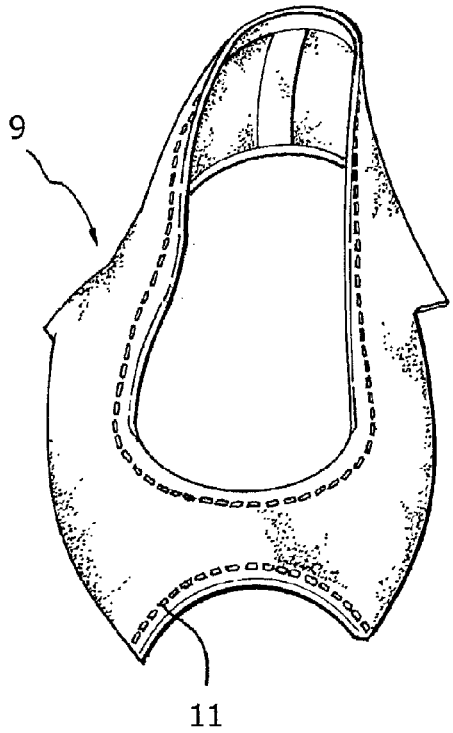
FIG. 1A is a top perspective view of an upper, according to one aspect of the present invention supporting in a spayed manner on a support surface.
Figure 1B:
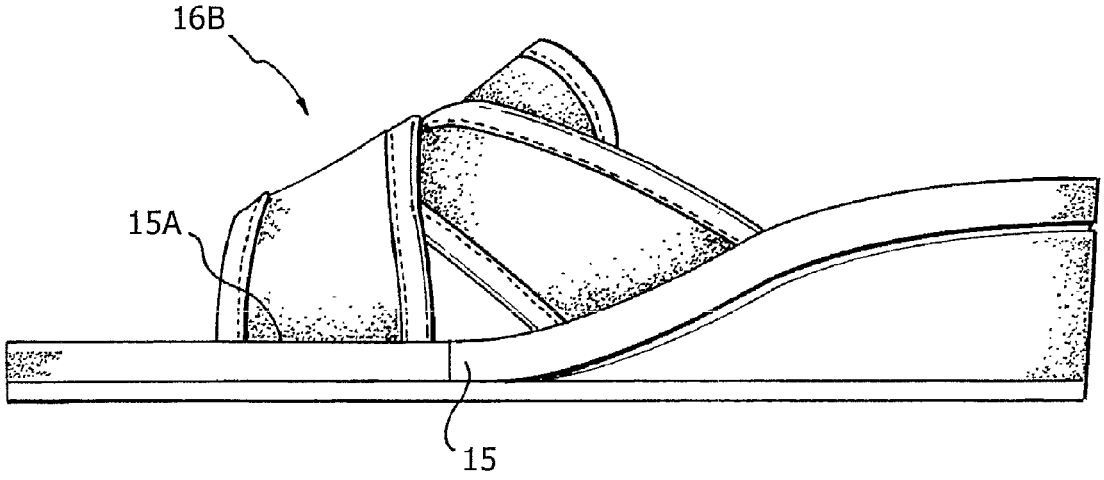
Fig. 1B (Prior Art)
FIG. 1B is a close side view of a conventional "California Construction" with a concealed or closed stitch in a flat style shoe.
Figure 1C:
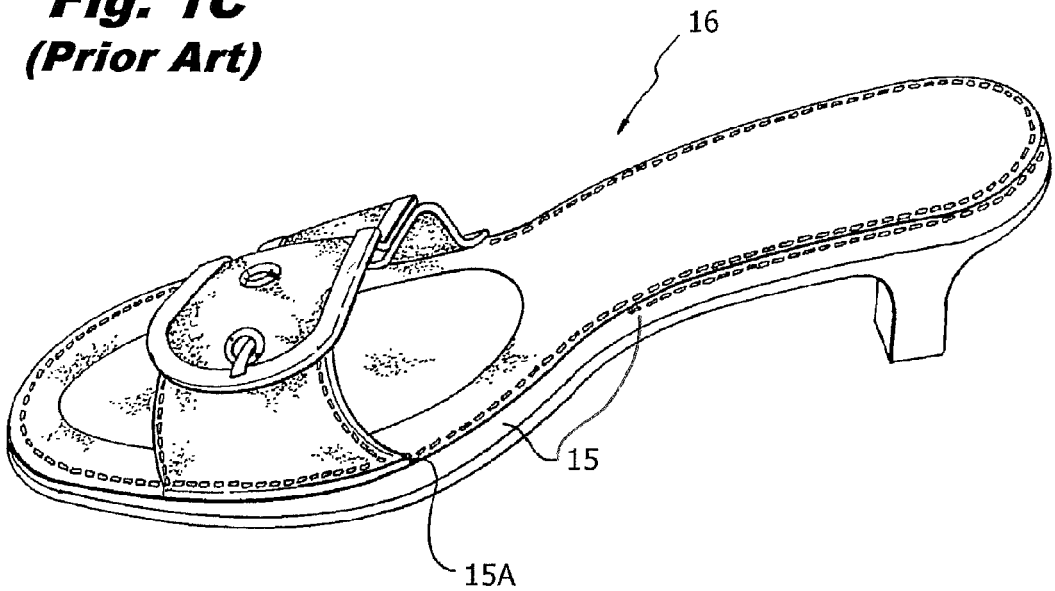
Fig. 1C (Prior Art)
FIG. 1C is a close side view of a conventional "Reverse California" construction with a fully exposed box-type stitch.
Figure 1D:
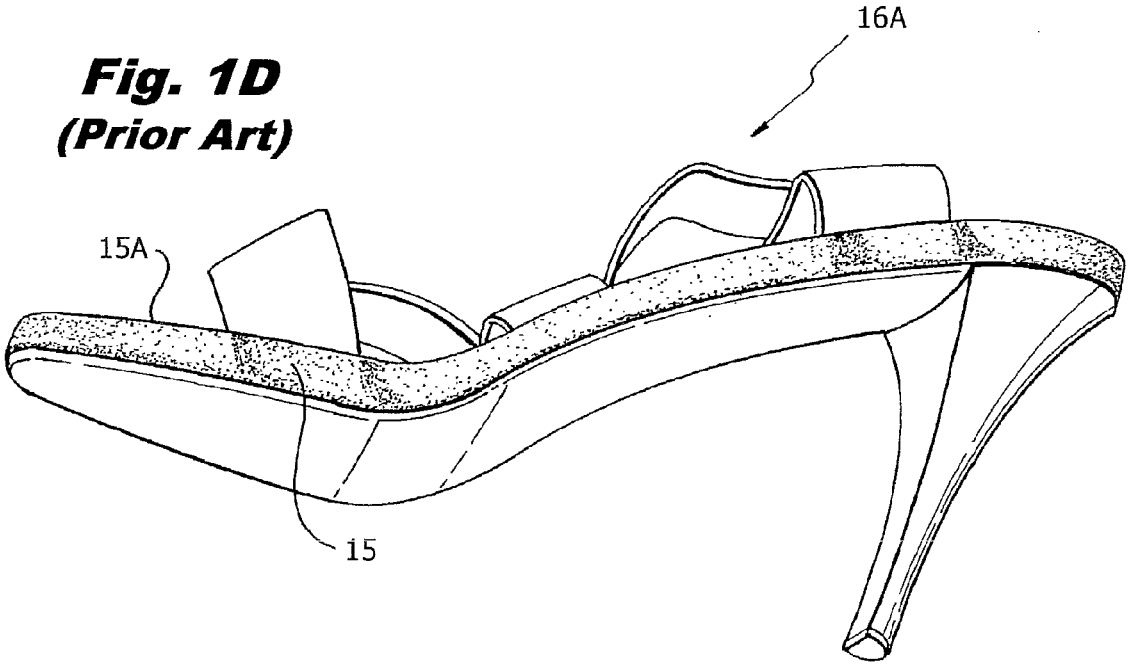
Fig. 1D (Prior Art)
FIG. 1D is a side perspective view of a conventional "California Construction" construction with a fully concealed stitch in a pump style shoe.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

In coping with the problems noted above, the present invention provides a system for manufacturing footwear, particularly ladies shoes that combines a stitch and assemble method that substantially departs from conventional construction as discussed earlier and provides a solution to the detriments noted earlier.

Referring now to FIG. 1A through FIG. 11, (excluding conventional FIGS. 1B, 1C, and 1D), a shoe 1 having either an open toe construction or a shoe 1A (FIG. 11) having a closed toe construction, includes generally a toe portion 2 and a heel portion 3 joined by a substantially continuous sole member 5 and supported by a heal member 4, as shown.

During an initial assembly of shoes 1, 1A, partially assembled uppers 9 (FIG. 1A), 9A (FIG. 11) are prepared and detailed in a partially assembled manner with a sewn series of decorative stitches 11 to enhance the visual appearance of shoes 1, 1A. It will be understood, uppers 9, 9A may also be referred to as upper members or upper constructions without bringing confusion to the skillful reader.

Figure 2:
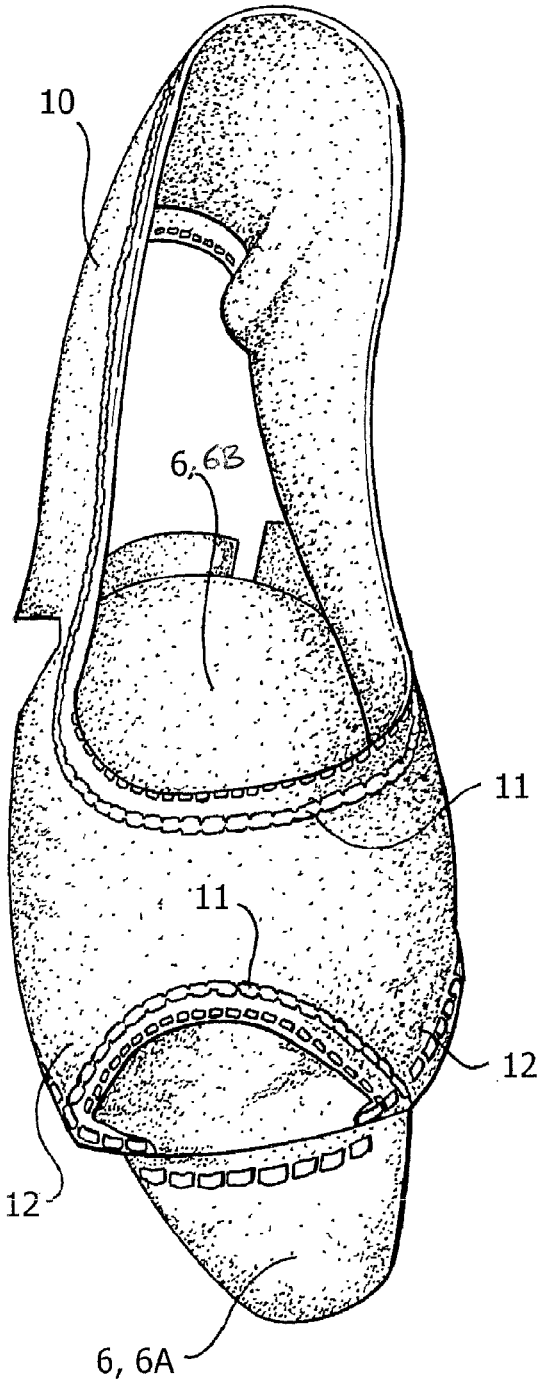
FIG. 2 is a top perspective view of an assembled upper member including an upper glue tongue member with glue flanges for later assembly. It is noted that the glue flanges are spayed on the support surface for an improved perspective view.
Figure 3:
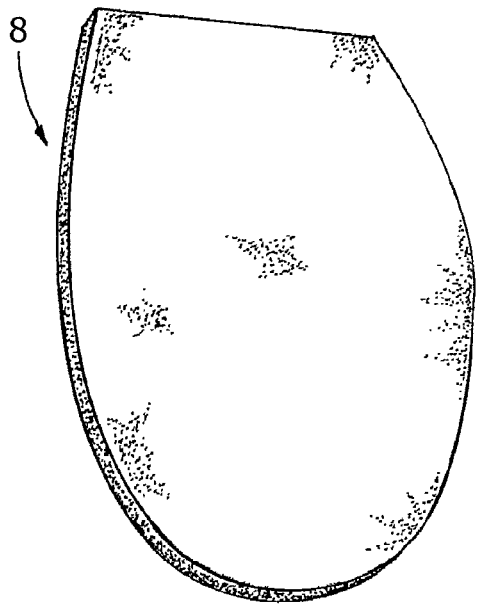
FIG. 3 is a top plan view of a foam cushion member prior to assembly.
Figure 4:
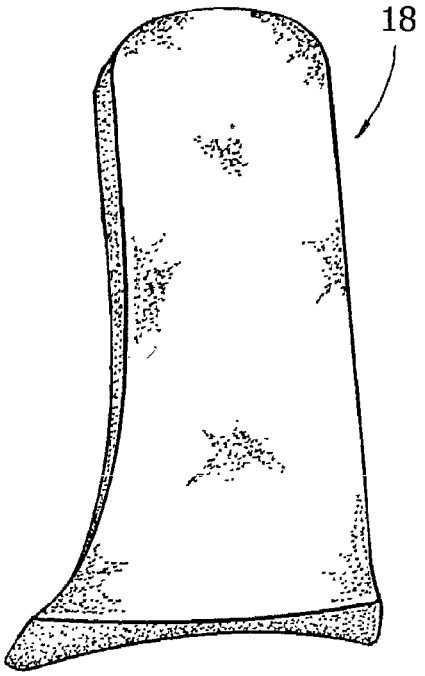
FIG. 4 is a top plan view of a board support member prior to assembly.
Figure 7:
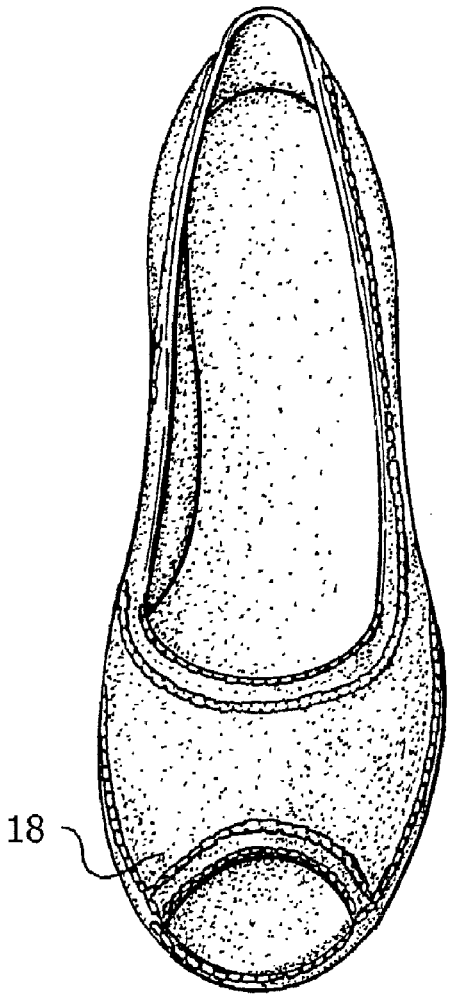
FIG. 7 is a top plan view of an assembly between a sole member (FIG. 6) and the completed upper member assembly (FIG. 5).
Figure 8:
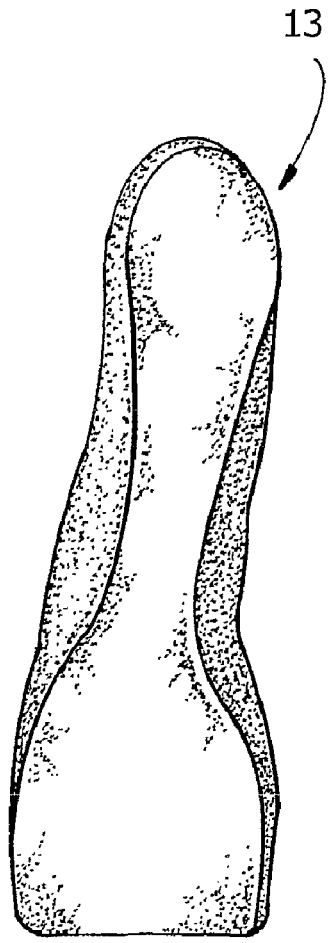
FIG. 8 is a top side perspective view of an insole member prior to assembly.

A second member, referred to herein as an upper glue tongue member 6 (Shown in FIGS. 2 and 9A) serves as both a partial foot bed and provides and includes additional glue flange members 6A as will be discussed. Upper glue tongue member 6 having glue flanges 6A, prepared optionally here as two individual members (6 and 6A) and then combined and attached via stitched at stitch lines 12, 12A to toe portion 2 of the bottom edge of upper 9, 9A. It is noted that glue flanges 6A extend only partially around upper member 9, form a left side mid-point 6C to a right side mind-point 6D (FIG. 9A). This is best shown in FIGS. 2 and 9A, using either an exposed box-type or other stitch (see FIGS. 2, 9A) or a concealed stitch 12A (as is used in FIG. 11). Following an assembly of upper members 9, 9A and upper glue tongue member 6 with glue flanges 6A, an assembled upper member 10 is formed (FIG. 2). As a particular benefit of the present construction, glue flanges 6A are not present near heal portion 3 and do not generate assembly difficulties with bunching or layering during the tight radius along the heal curve shown in FIG. 9 or 9A.

Figure 12:
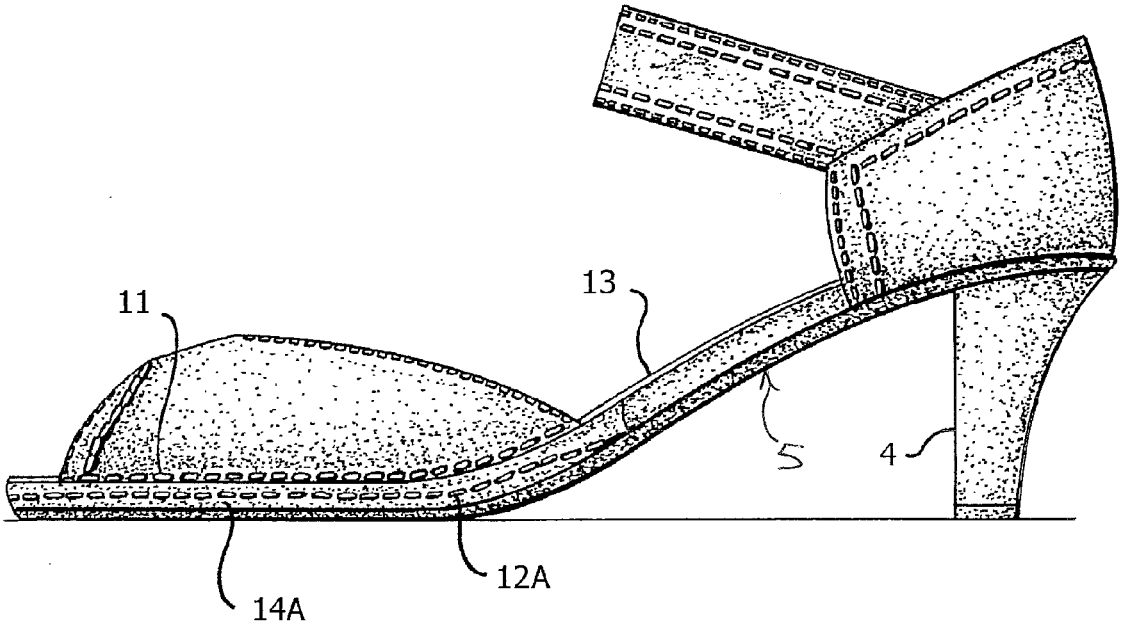
FIG. 12 is a topside perspective view of a third alternative embodiment of an assembled shoe having an exposed or box-stitch-semi-seam construction on a toe portion thereof.

Assembled upper member 10 consists of upper glue tongue member 6, with glue flanges 6A and the initially prepared upper members 9, 9A depending upon the desired construction details. As will be recognized by those of skill in the art studying the entire disclosure, particularly FIGS. 10, 11, and 12, upper members 9, 9A may include differing shapes, sizes, and details. Where a concealed stitch 12A is employed, those of skill in the art will recognize studying the instant enclosure that, when a concealed seam is desired that upper members 9A and glue tongue member 6 are assembled initially reversed, stitched, and the returned to their original orientation creating finished seam 12A with a concealed stitch.

Sole 5 is of conventional PVC (polyvinyl chloride) construction as shown, but may be constructed from any suitable material both organic (leather/rubber) and inorganic (man-made (PVC and related clastomeric materials)) substances as known to those of skill in the art without departing from the scope of the present invention. Sole 5 may additionally include any desired tread portions (not shown) for gripping during use, as may be determined by a manufacturer without departing from the scope and spirit of the present invention.

Following assembly of upper assembly 10 (FIG. 2), a foam cushion member 8, shown here at a partial or toe-length, is assembled with a surface portion of upper glue tongue member 6 between glue flanges 6A. As will be understood by those of skill in the art, cushion member 8 provides the principal cushion for the fore-part or toe portion 2 of a user's foot during use. Cushion member 8 may be assembled with (on the bottom surface or optionally the top surface thereof) upper glue tongue member 6 in any conventional way, most commonly employing adhesive alone or in combination with additional perimeter stitching (not shown). It will be recognized, that following an assembly with foam cushion member, upper assembly 11 now includes (fixably) the foam cushion member 8 and is ready for a subsequent assembly stage.

A stiffening member or insole support board member 18 generally spans the width of sole 5 as shown, is joined with upper assembly 10 about the lower periphery of heal portion 3 and along a contact region or side surface 6B of upper glue tongue member 6 as combined with cushion member 8. This assembly may be accomplished by employing a conventional perimeter adhesive as shown in FIG. 9A to allow a smooth physical transition between rear-heal region 3 of upper assembly 10 and a bottom of insole support board member 18. As will be noted in more detail below (FIG. 9A), support board member 18 is may also include an adhesive wrapped portion of glue flange members 6A to secure upper 9 completely to board member 18 along an entire available area so that the inner portion of upper assembly 10 smoothly transitions to support board member 18 to minimize potential rubbing on a user's foot following final assembly.

In a similar process to the assembly above, glue flanges 6A of upper glue tongue member 6 wrap about a portion of support board 18 and provide stiffening support and prevent unintended distortion of toe portion 2 relative to rear portion 3 during shipping and use.

As will be recognized by those of skill in the art, during the assembly with board support member 18, cushion member 8 is securely positioned on all sides as shown in FIG. 9A, thereby creating side tongue exposure regions 14 (FIGS. 9, 9A, 10, 12), 14A (FIG. 11) between stitch lines 12, 12A and the bottom region of now assembled upper 10 in a final upper construction assembly 7.

As a consequence of the proposed construction method, a completed upper construction 7 employs only a limited portion either an exposed or concealed type seam construction and allows for the inclusion of an additional functional and decorative tongue members and also the inclusion of alternative heal portion 4 construction techniques in a manner previously unknown to those of skill in the art. As a consequence, the present invention readily overcomes the detriments noted in the related arts.

Following assembly of final upper construction assembly 7 (FIG. 5), sole member 5 (FIG. 6) and heal 4 are secured to upper construction 7 employing any available selected techniques such as gluing as shown, allowing adaptive combinations between assembly techniques previously unrecognized by those of skill in the art. Following final assembly of 7, an insole member 13 is inserted and secured within upper construction 7, and a heal member 4, if required by the desired construction manufacturer, are assembled, thereby completing assembly of shoes 1, 1A.

In this way, the multiple construction members are secured and shoes 1, 1A are provided in a suitable form for consumer use that overcomes the detriments noted above. This construction also binds upper glue tongue glue flanges 6A while providing a pleasing outward appearance adaptable to both an exposed seam 12 (FIG. 12) or concealed seam 12A (FIG. 11). This construction technique also allows the inter combination of differing techniques between a toe portion 2 and a heal portion 3 of a shoe construction, thereby overcoming the detriments known to those of skill in the art.

As will be recognized by those of skill in the art, while the present disclosure involves the use of stitching, gluing, or the use of adhesives for fixing or securing one member to another, these are non-limiting uses and similar phrases such as bonding, assembling, etc. may be used without departing from the scope and spirit of the present invention.

Additionally, it will be recognized that while the present construction depicts the use of a board support member 18 as part of an overall assembly, it will be recognized that support board ember 18 may be substituted or combined with other sole or tread members (for example with sole member 5 without departing from the scope or spirit of the present invention. Consequently, when board support member 18 and heal member 5, however construction shall be understood to refer generally and without limitation to sole construction or sole assembly members without limitation, thereby along the use of multiple or differently shaped supports or sole members without requiring the simultaneous use of both members or a particular shape of either.

Finally, those of skill in the art will recognize that while the present embodiments discuss generally shoes, particularly female shoes of multiple styles, these are not limiting and the entire disclosure may be applied to the broader field of footwear construction without departing from the scope and spirit thereof.

In the claims, any means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A method for manufacturing a shoe, comprising the steps of:

employing one of a stitching and a gluing to secure an upper glue tongue member portion to a toe portion of an upper member of a shoe;

said upper glue tongue member including glue flanges along a toe portion of said upper member from a first side region mid-point to a second side region mid-point;

securing said upper glue tongue member affixed to said toe portion of said upper member to a cushion member on a contact region thereof;

securing said upper member and said upper glue tongue member to a surface of a support board member;

securing at least a portion of said upper glue tongue member to said support board member;

securing a toe region of a sole construction member to at least one of said upper member, said upper glue tongue member, said support board member, thereby securing a toe region of said sole construction member to said outer surface of said upper glue tongue portion; and securing a heel portion of said sole construction member to at least one of said upper member and said support board member, there by enabling an alternative method for manufacturing a shoe.

2. A method according to claim 1, wherein:

said step of securing a portion of said upper glue tongue member includes at least one of a step of stitching, gluing, and a bonding, whereby said upper glue tongue member is affixed to said cushion member.

3. A method according to claim 1, wherein:

said step of securing a portion of said upper member and said upper glue tongue member includes at least one of a step of stitching, gluing, and a bonding, whereby said portion is affixed to said at least one of said support board member and said sole assembly.

4. A shoe apparatus assembly constructed according to the steps in claim 1.

5. A method for manufacturing a shoe, comprising the steps of:

employing a stitch method for securing an upper glue tongue portion to a toe portion of an upper portion;

adhesively securing a portion of said upper glue tongue portion extending from said upper portion to a cushion member on an inner side thereof;

adhesively securing said portion of said upper glue tongue portion to a top surface of a sole assembly on an outer side thereof;

at least one of a step of employing a glue to a top portion of a sole construction member, and employing a glue to said outer side of said upper glue tongue portion thereby securing a toe region of said sole construction member to said outer surface of said upper glue tongue portion; and adhesively securing a heel portion of said upper portion to said sole construction member, there by enabling an alternative method for manufacturing a shoe.

* * * * *